US007077295B2

(12) United States Patent
Walker

(10) Patent No.: US 7,077,295 B2
(45) Date of Patent: Jul. 18, 2006

(54) AEROSOL NOZZLE

(76) Inventor: Johnny Walker, Box 1463, Temple, TX (US) 76503

( * ) Notice: Subject to any disclaimer, the term of this patent is extended or adjusted under 35 U.S.C. 154(b) by 19 days.

(21) Appl. No.: 10/966,346

(22) Filed: Oct. 15, 2004

(65) Prior Publication Data

US 2006/0081659 A1 Apr. 20, 2006

(51) Int. Cl.
*B67B 5/00* (2006.01)

(52) U.S. Cl. ..... 222/153.09; 222/570; 239/600

(58) Field of Classification Search ..... 222/153.09, 222/527, 570; 239/600
See application file for complete search history.

(56) References Cited

U.S. PATENT DOCUMENTS 3,472,457 A * 10/1969 Mcavoy ..... 239/337
4,305,528 A * 12/1981 Craig ..... 222/182
5,890,631 A * 4/1999 Spurlock et al. ..... 222/538
6,783,037 B1 * 8/2004 Bonham ..... 222/570

* cited by examiner

*Primary Examiner*—Philippe Derakshani
(74) *Attorney, Agent, or Firm*—Marcus Hammack

(57) ABSTRACT

An improved aerosol spray dispenser that includes a nozzle extension that does not come detached from the aerosol actuator and become lost. This will allow the consumer a more convenient usage of aerosol sprays that require extensions to concentrate the spray and eliminate the likelihood that a nozzle extension will become misplaced between uses.

2 Claims, 2 Drawing Sheets

AEROSOL NOZZLE

BACKGROUND OF THE INVENTION

1. Field of the Invention

The present invention relates to the field of aerosol sprays, such as are used in lubricant oils, air fresheners, hair sprays, paints, foam cleaners, and compressed air.

2. Background Information

Aerosols are an integral part of our everyday lives and are a useful way to deliver paint, insecticide, lubricant oil, air freshener, hair products, foam cleansers, perfumes, or compressed air. Aerosols typically work by delivering a liquefied propellant or a compressed gas in the form of a spray. These sprays can be composed of small, medium, or large droplets, depending upon the function of the aerosol.

The product to be delivered in the form of a spray typically travels up a "dip tube" into the "valve housing." There is it propelled up and out through the "spray actuator" which fits onto the "valve stem" itself. A problem is commonly encountered in these systems when the product to be delivered in the form of a spray must be concentrated into a small area. This requires a nozzle to be attached to the spray actuator in order to control the stream of the spray. These nozzles are useful, indeed necessary, in certain types of aerosol applications, such as lubricant oils and compressed air, as used to clean computer keyboards and other electronics.

When using an aerosol product that requires a concentrator nozzle, manufacturers typically attach a nozzle extension to the aerosol dispenser for use by the consumer. The consumer detaches the nozzle extension and attaches it to the spray actuator of the aerosol dispenser. This works fine until time to store the aerosol product. At that time the nozzle extension is removed, or falls off, and is then very difficult, if not impossible, to find the next time the product is needed. Some consumers attempt to solve the problem by rubber-banding or taping the nozzle extension to the can itself. There is a simpler solution, and the present invention discloses it: produce a non-detachable nozzle that is an integral extension of the spray actuator.

SUMMARY OF THE INVENTION

In view of the foregoing, it is an object of the present invention to provide a convenient, easy way to concentrate an aerosol spray.

It is another object of the present invention to provide an aerosol nozzle extension that does not detach from the aerosol spray apparatus and become lost when not in use.

In satisfaction of these and other related objectives, Applicant's present invention permits practitioners to create an integral nozzle extension that will remain attached to an aerosol dispenser and therefore be more convenient for the consumer.

Applicant's approach to the problem described above is certainly simple, but it is equally unobvious. Applicant's integral nozzle extension permits, for the first time, the assurance that the consumer will have access to a nozzle's spray-concentrating abilities when using an aerosol spray product.

DETAILED DESCRIPTION OF THE PREFERRED EMBODIMENT

Figure 1:
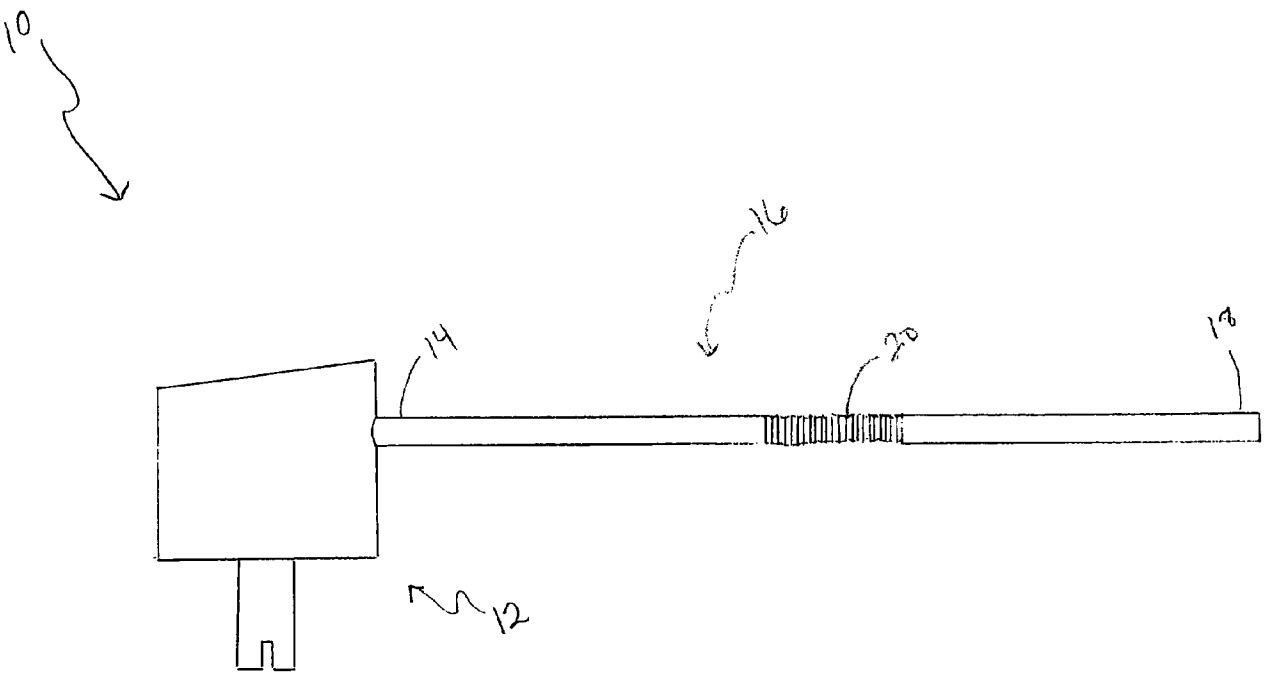
FIG. 1 is a side view of the improved aerosol dispenser of the present invention.

With reference to FIG. 1, the improved aerosol dispenser of the present invention is identified generally by the reference number 10.

Improved aerosol dispenser 10 includes an aerosol container, not shown in the figures; an aerosol valve, not shown in the figures; and spray actuator 12, which fits over the aerosol spray valve in a manner common in the field to activate the aerosol valve and cause the propellant and product within the aerosol container to be delivered in aerosol form.

In FIG. 1, proximal end 14 of elongate nozzle conduit 16 is integral with spray actuator 12, being attached by glue, or similar means common in the field. Conduit 16 is tubular and oriented to have a continuous passage through which is designed to permit the flow of the compressed materials held within the aerosol container. In the preferred embodiment shown in FIG. 1, corrugated, flexible segment 20 is medial of proximal end 14 and distal end 18 of conduit 16. In this embodiment, conduit 16 can be bent at segment 20, to allow easier storage of the aerosol dispenser without detaching conduit 16. This solves the problem of misplacing conduit 16 between uses of the aerosol dispenser.

Figure 2:
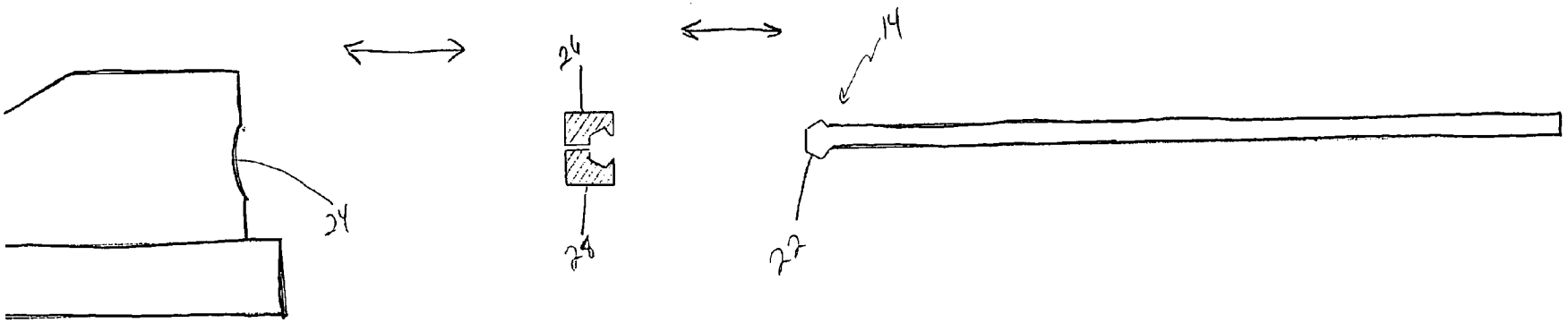
FIG. 2 is a side view of another embodiment of the improved aerosol dispenser of the present invention.

In FIG. 2 is shown a different attachment means consisting of proximal end 14 of conduit 16 comprising a projecting lobe member 22 which is configured to reversibly interlock with lobe-receiving recess 24 in the aerosol actuation means, in this embodiment by means of two lobe receiving members 26 and 28 which fit around lobe member 22 and which fit into lobe-receiving recess 24. As in the other embodiment shown in FIG. 1, this solves the problem of misplacing conduit 16 between uses of the aerosol dispenser and yet would allow conduit 16 to be removed for cleaning when necessary. Of course, although not shown in FIG. 2, conduit 16 in this embodiment could also include a corrugated, flexible segment 20 as shown in FIG. 1.

Although the invention has been described with reference to specific embodiments, this description is not meant to be construed in a limited sense. Various modifications of the disclosed embodiments, as well as alternative embodiments of the inventions will become apparent to persons skilled in the art upon reference to the description of the invention. It is, therefore, contemplated that the appended claims will cover such modifications that fall within the scope of the invention.

I claim:

1. An improved fluid dispenser comprising:

a spray actuating means having an input and an output;

an elongate conduit member having a proximal end, a distal end, and a medial segment, said proximal end being characterized by an enlarged lobe shape, said distal end being configured to allow free transit of fluid, said medial end being characterized by a plurality of corrugated, flexible segments working in combination to allow relative movement between said proximal end and said distal end; and an attachment means having a proximal and distal end, said attachment means being comprised of a first attachment member and a second attachment member wherein said first and second attachment members combine to form a configuration to lockingly engage said elongate conduit member proximal end at said attachment means distal end and a configuration for reversible engagement with said spray actuating means output at said attachment means proximal end.

2. An improved fluid dispenser comprising a spray actuating means attached to an elongate conduit at a proximal end of said elongate conduit, said elongate conduit being configured wherein a medial portion of said elongate conduit is characterized by a plurality of corrugated, flexible segments working in combination to allow relative movement between said elongate conduit proximal end and a distal end of said elongate conduit.

* * * * *